US006049172A

United States Patent [19]

Hirschmann et al.

[11] Patent Number: 6,049,172

[45] Date of Patent: Apr. 11, 2000

[54] IGNITION APPARATUS FOR A DISCHARGE LAMP

[75] Inventors: Guenther Hirschmann, Munich; Juergen Becker, Berlin; Gerhard Behr, Altheim; Christian Wittig, Munich; Peter Helbig, Sontheim, all of Germany

[73] Assignee: Patent-Treuhand-Gesellschaft fuer elektrische Gluehlampen mbH, Munich, Germany

[21] Appl. No.: 09/206,894

[22] Filed: Dec. 8, 1998

[30] Foreign Application Priority Data

Jan. 28, 1998 [DE] Germany ..... 198 03 139

[51] Int. Cl.[7] ..... H05B 37/00

[52] U.S. Cl. ..... 315/82; 315/77; 315/289; 307/10.8

[58] Field of Search ..... 315/289, 291, 315/82, 77, 278, 290, 284; 307/10.8

[56] References Cited

U.S. PATENT DOCUMENTS

| | | | |
|---|---|---|---|
| 3,879,617 | 4/1975 | Faller et al. | 307/10.8 |
| 5,268,617 | 12/1993 | Daub et al. | 315/82 |
| 5,491,417 | 2/1996 | Miyata et al. | 324/402 |
| 5,828,174 | 10/1998 | Seiler et al. | 315/82 |
| 5,990,633 | 11/1999 | Hirschmann et al. | 315/291 |

FOREIGN PATENT DOCUMENTS

| | | |
|---|---|---|
| 43 33 886 A1 | 4/1995 | Germany . |
| 195 21 070 A1 | 12/1995 | Germany . |
| 196 10 385 | 9/1997 | Germany . |
| 196 10 388 A1 | 9/1997 | Germany . |
| WO 97/04624 | 2/1997 | WIPO . |

OTHER PUBLICATIONS

Patent Abstract —Japan Pub. #06196336 Jul. 15, 1994.

*Primary Examiner*—Haissa Philogene
*Assistant Examiner*—Wilson Lee
*Attorney, Agent, or Firm*—William E. Meyer

[57] ABSTRACT

The invention relates to an ignition apparatus for a discharge lamp, in particular high-pressure discharge lamp for motor vehicle headlights. The ignition apparatus, which is preferably designed as a pulse ignition device, is accommodated in the lamp base. According to the invention, it has; a plate (1), which is composed of an electrically conductive material, is matched to the geometry of the base and on which at least the ignition capacitor (C1) and the spark gap (F1) are fastened, at least one first electrical connection of the ignition capacitor (C1) and at least one first electrical connection of the spark gap (F1) being electrically conductively connected to the plate (1).

18 Claims, 3 Drawing Sheets

IGNITION APPARATUS FOR A DISCHARGE LAMP

TECHNICAL FIELD

The invention relates to an ignition apparatus for a discharge lamp according to the preamble of Patent Claim 1, and to a discharge lamp having an ignition apparatus of this type.

In particular, the invention relates to an ignition apparatus for a high-pressure discharge lamp which is used in a motor vehicle headlight, for example. The ignition apparatus is part of an operating unit of this high-pressure discharge lamp. It generates high-voltage pulses of more than 20 kV across the lamp electrodes when the lamp is switched on, in order to initiate a gas discharge in the high-pressure discharge lamp.

BACKGROUND ART

An ignition apparatus corresponding to the preamble of Patent Claim 1 is disclosed in the PCT application with the international publication number WO 97/04624. This ignition apparatus is a pulse ignition apparatus for a high-pressure discharge lamp. The pulse ignition apparatus has an ignition transformer having a primary winding and a secondary winding, an ignition capacitor, a resistor element, via which the ignition capacitor is charged, and an automatic switch. One connection of the secondary winding is connected to one of the gas discharge electrodes of the high-pressure discharge lamp, while its other connection is connected to the voltage input of the ignition apparatus. The primary winding of the ignition transformer and the switching path of the automatic switch are arranged in such a way that the discharge current of the ignition capacitor flows through them.

The German Published Patent Application DE 196 10 385 describes a discharge lamp, in particular a high-pressure discharge lamp for use in a motor vehicle headlight, having a ballast which is accommodated in the lamp base and has an ignition apparatus.

DISCLOSURE OF THE INVENTION

The object of the invention is to provide an ignition apparatus for a discharge lamp which enables simplified mounting of the ignition apparatus, in particular in the lamp base of the discharge lamp.

This object is achieved according to the invention by means of the characterizing features of Patent Claim 1. Particularly advantageous designs of the invention are described in the subclaims.

The ignition apparatus according to the invention has a voltage input for supplying the ignition apparatus with a voltage, an ignition voltage output, a capacitor having at least one first electrical connection and at least one second electrical connection, an automatic switch having at least one first electrical connection and at least one second electrical connection, a transformer having at least one primary winding and at least one secondary winding and a plate, which is composed of an electrically conductive material and on which at least the capacitor and the automatic switch are fastened, at least one first electrical connection of the capacitor and at least one first electrical connection of the automatic switch being electrically conductively connected to the plate. Use of a plate composed of an electrically conductive material permits the capacitor and the automatic switch of the ignition apparatus to be designed as a prefabricated structural unit and be mounted in the lamp base, for example. Since the plate is composed of an electrically conductive material, the plate riot only serves to retain the capacitor and the automatic switch, but also additionally establishes electrical contact between these components.

The plate is advantageously designed as a metal plate or as a sheet-metal strip because metal plates and sheet-metal strips have, on the one hand, good electrical conductivity and, on the other hand, sufficient stability for the fixing of the capacitor and automatic switch and can be shaped virtually as desired. This plate is advantageously provided with at least one electrical connection in order to supply the electronic components arranged on it with electrical energy. Moreover, the plate advantageously has one or more bent or curved sections (1*a*). As a result, the structural unit of the ignition apparatus, which structural unit comprises the plate and the electronic components fastened thereto, can be adapted to differently configured cavities. In a preferred exemplary embodiment of the invention, the plate is shaped to form a ring segment, for example, in order to accommodate it together with the capacitor fixed thereon and the automatic switch in a cylindrical cavity of a lamp base.

Furthermore, the ignition apparatus according to the invention advantageously has a first connecting means, which is fastened to the at least one second electrical connection of the capacitor and serves for the electrical and mechanical connection of the capacitor to a component of the ignition apparatus, for example to the transformer. In addition, the ignition apparatus according to the invention advantageously has a second connecting means, which is fixed or the at least one second electrical connection of the automatic switch and serves for the electrical and mechanical connection of the automatic switch to a component of the ignition apparatus, for example to the transformer. The first or second connecting means or both are advantageously designed as sheet-metal strips provided with an electrical connection or as power supply wires whose shape can be matched to the predetermined spatial conditions in the lamp base or in the housing of the operating unit. Furthermore, these sheet-metal strips or power supply wires advantageously have one or more U-shaped sections, which serve as strain relief in order to reduce the mechanical stresses caused by their thermal expansion. This measure is particularly important when the ignition apparatus is surrounded by an electrically insulating, curable potting compound.

The ignition apparatus according to the invention is advantageously accommodated in tie lamp base of a discharge lamp which is equipped with a discharge vessel, a lamp base and means for generating a gas discharge inside the discharge vessel. In a particularly advantageous manner, the ignition apparatus according to the invention can be inserted into the base of a high-pressure discharge lamp, having a base at one end, for a motor vehicle headlight.

BRIEF DESCRIPTION OF THE DRAWINGS

The invention is explained in more detail below using a preferred exemplary embodiment. In the figures.

BEST MODE FOR CARRYING OUT THE INVENTION

Figure 1:
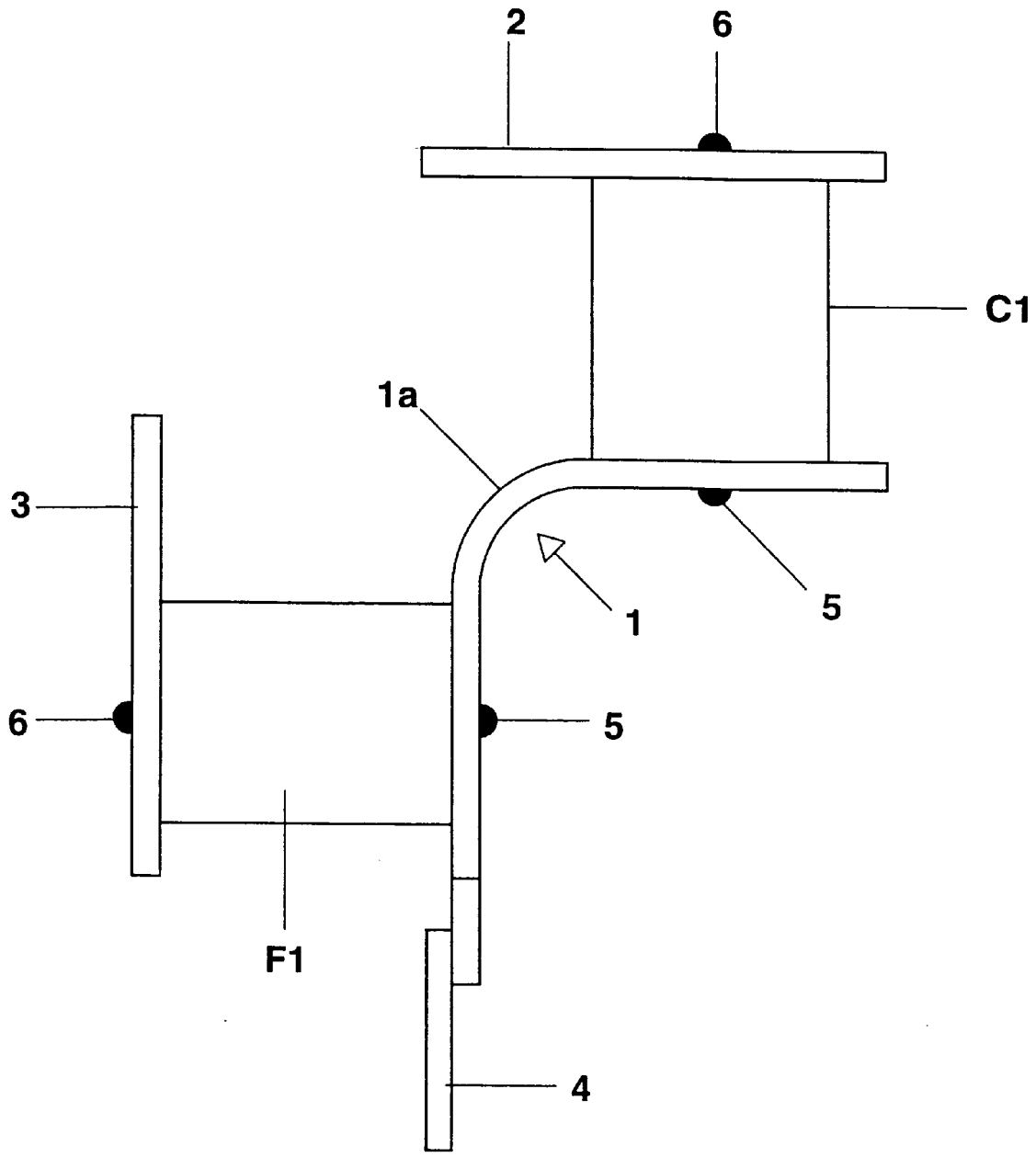
FIG. 1 shows a diagrammatic illustration of the structural unit of the inventive ignition apparatus in accordance with the preferred exemplary embodiment, which structural unit comprises the ignition capacitor, the spark gap, the metal plate and the sheet-metal strip.

The preferred exemplary embodiment of the invention is a pulse ignition apparatus for a high-pressure discharge lamp with a power consumption of approximately 35 W which is inserted into a motor vehicle headlight, for example. This ignition apparatus (FIG. 3) has a transformer TR having two primary windings N1, N2, which are connected in parallel, and a secondary winding N3 which is coupled inductively to both primary windings, an automatic switch designed as a spark gap F1, an ignition capacitor C1, a further capacitor C2, two inductors L1, L2, a DC voltage input J1, J2 and J3, and an ignition voltage output J4, J5. The ignition capacitor C1 and the spark gap F1 are fastened on a metal plate 1 which is shaped as a ring segment and with which they form a prefabricated structural unit. In order to fasten the ignition capacitor C1 and the spark gap F1 on the metal plate 1, an electrical connection of the ignition capacitor C1 and of the spark gap F1 is in each case connected to the metal plate 1 by one or more welds 5. This structural unit furthermore includes two sheet-metal strips 2, 3 and a wire 4, which is welded to the metal plate 1 and serves the metal plate 1 as electrical connection. The first sheet-metal strip 2 is connected to the second electrical connection of the ignition capacitor C1 by one or more welds 6. The second sheet-metal strip 3 is connected to the second electrical connection of the spark gap F1 by one or more welds 6. A free end of the first sheet-metal strip 2 and of the second sheet-metal strip 3 is in each case provided with an electrical connection which serves for the electrical connection of the beginning and of the end of the primary windings N1, N2 to the second connection of the ignition capacitor C1 and to the second connection of the spark gap F1, respectively. FIG. 1 shows, in a diagrammatic illustration, a plan view of this prefabricated structural unit of the ignition apparatus according to the preferred exemplary embodiment. The electrical connection (not represented) of the sheet-metal strips 2, 3 is designed, for example, as a terminal or a plug device or else as a soldered or welded contact.

Figure 2:
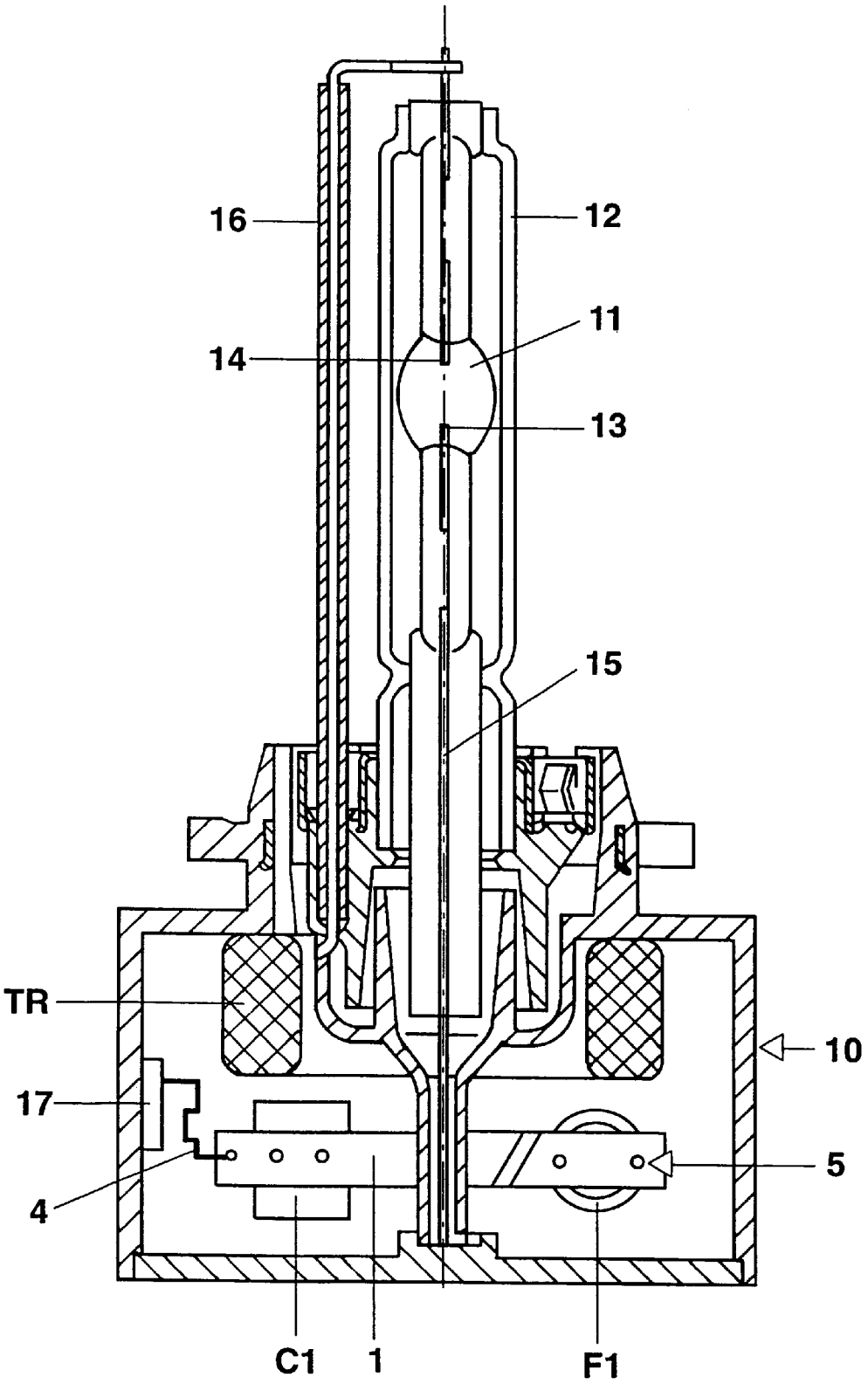
FIG. 2 shows a diagrammatic illustration of a high-pressure discharge lamp having a base at one end, with an ignition apparatus according to the preferred exemplary embodiment.

FIG. 2 shows a high-pressure discharge lamp, having a base at one end, with an ignition apparatus according to the preferred exemplary embodiment described above. The high-pressure discharge lamp has a lamp base 10 made of plastic and a discharge vessel 11 having an end near the base and an end remote from the base, and also an outer bulb 12 enclosing the discharge vessel 11, which are anchored in the lamp base 10. Arranged inside the discharge vessel are two gas discharge electrodes 13, 14, which are supplied with electrical energy via a power supply line 15 near the base and a power supply line 16 remote from the base, respectively. The components of the ignition apparatus are accommodated in the interior of the lamp base 10. The transformer TR is designed as a toroidal-core transformer and is arranged inside the lamp base 10 coaxially with respect to the two lamp vessels 11, 12. The metal plate 1, which is bent like a ring segment and has the ignition capacitor C1 fixed on it and the spark gap F1 fastened on it, is arranged in an accommodating device tailored thereto inside the lamp base 10. The wire 4 welded to the metal plate 1 is connected to an electrical contact 17 on the inner wall of the lamp base 10. The electrical connection provided on tile first sheet-metal strip 2 (not represented in FIG. 2) is connected to the beginning of the primary windings N1, N2 of the transformer TR. The electrical connection provided on the second sheet-metal strip 3 (not represented in FIG. 2) is connected to the End of the primary windings N1, N2 of the transformer TR.

Figure 3:
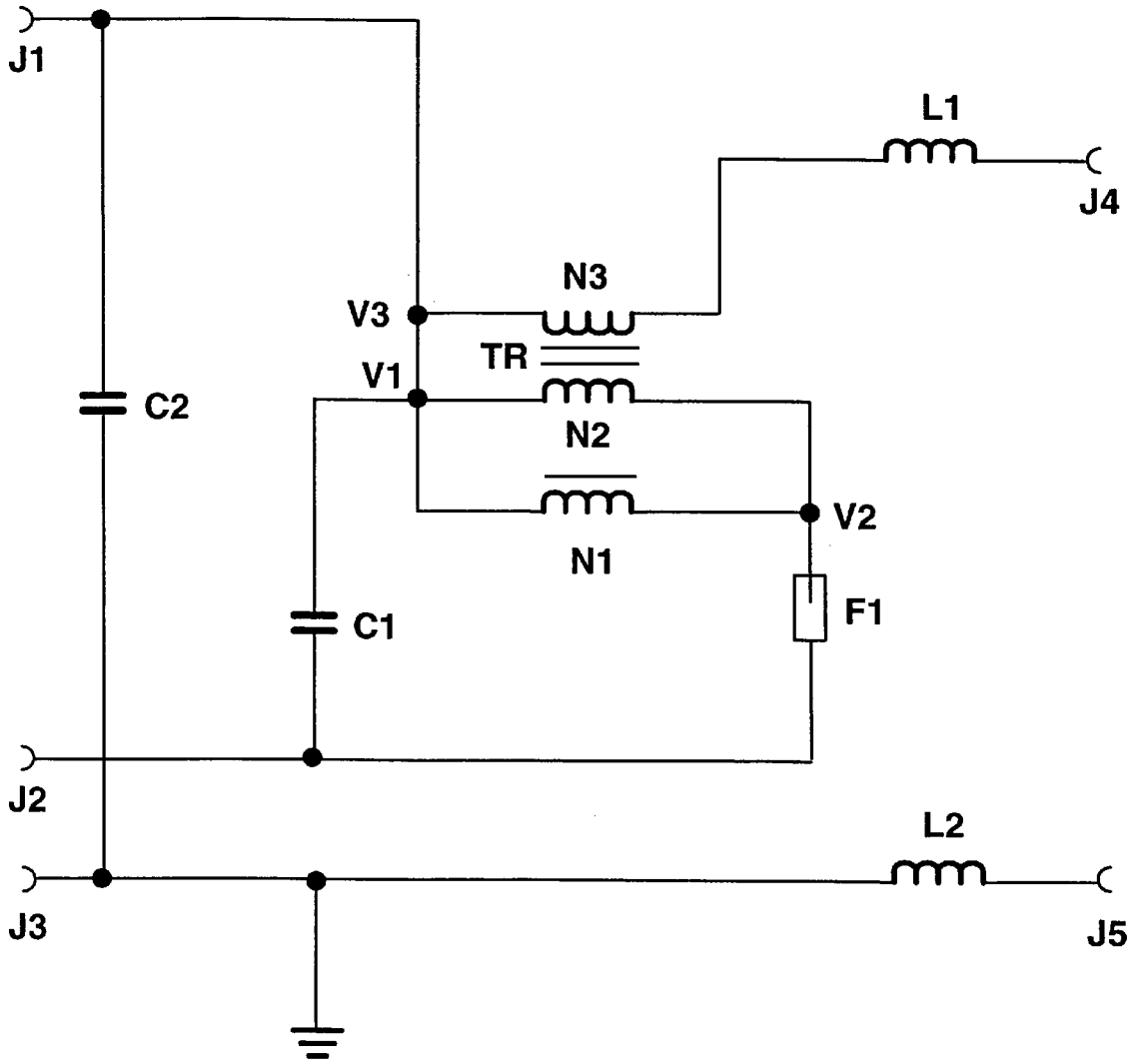
FIG. 3 shows a sketched circuit diagram of the ignition apparatus according to the preferred exemplary embodiment.

FIG. 3 shows a sketched circuit diagram of the ignition apparatus according to the preferred exemplary embodiment. The ignition apparatus has three DC voltage inputs J1 (for −400 V supply voltage), J2 (for +600 V supply voltage), J3 (connected to earth potential), two of which are optionally used. The DC voltage input J1 is connected via the junction points V3, V1 to the second connection of the ignition capacitor C1. The first connection of the ignition capacitor C1 (68 nF; 1000 V) is connected to the DC voltage input J2 and via the metal plate 1 to the first connection of the spark gap F1. The junction point V3 is connected to the ignition voltage output J4 via the secondary winding N3 of the transformer TR and the inductor L1 connected downstream. The junction point V1 is connected to the beginning of the two primary windings N1, N2 connected in parallel. The end of the two primary windings N1, N2 is connected via the junction point V2 to the second connection of the spark gap F1. The DC voltage input J3 is connected to the ignition voltage output J5 via the inductor L2. The ignition apparatus furthermore has a further capacitor C2 (4.7 nF; 1000 V), whose first connection is connected to the DC voltage input J1 and whose second connection is connected to the DC voltage input J3.

The inductors L1, L2 and the additional capacitor C2 are likewise accommodated in chambers or recesses provided therefor in the interior of the lamp base 10.

The invention is not restricted to the exemplary embodiment explained in specific detail above. Not only the ignition capacitor C1 and the spark gap F1 but also further components, for example the additional capacitor C2 or the inductors L1, L2, can be fixed on the metal plate 1. Instead of the first sheet-metal strip 2 and the second sheet-metal strip 3, it is also possible to use, as connecting means, power supply wires which are connected via terminals, for example, to the primary windings N1, N2. The components arranged on the metal plate 1 can be fixed to the metal plate 1 by means of various connection techniques, for example by means of soldering, radio-frequency soldering, radio-frequency welding, laser welding, ultrasonic welding, spot welding, or by means of mechanical connection techniques such as clamping or plugging, for example. The components of the ignition apparatus, in particular the ignition capacitor C1 and the spark gap F1, can be processed with or without connection wires. For example, the ignition capacitor C1 or the spark gap may be SMD components (Surface Mounted Device). Furthermore, a sheet-metal strip can also be used instead of a metal plate 1.

What is claimed is:

1. An ignition apparatus for a discharge lamp, comprising:

a voltage input (J1, J2, J3) for supplying the ignition apparatus with a voltage, an ignition voltage output (J4, J5), a capacitor (C1) having at least one first electrical connection and at least one second electrical connection, an automatic switch (F1) having at least one first electrical connection and at least one second electrical connection, a transformer (TR) having at least one primary winding (N1) and at least one secondary winding (N3), wherein the ignition apparatus has a plate (1), which is composed of an electrically conductive material and on which at least the capacitor (C1) and the automatic switch (F1) are fastened, at least one first electrical connection of the capacitor (C1) and at least one first electrical connection of the automatic switch (F1) being electrically conductively connected to the plate (1).

2. The discharge lamp ignition apparatus according to claim 1, wherein the plate (1) is a metal plate.

3. The discharge lamp ignition apparatus according to claim 1, wherein the plate (1) is a sheet-metal strip.

4. The discharge lamp ignition apparatus according to claim 1, wherein the plate (1) has at least one bent or curved section (1*a*).

5. The discharge lamp ignition apparatus according to claim 3, wherein the plate (1) is shaped to form a ring segment.

6. The discharge lamp ignition apparatus according to claim 1, wherein the plate (1) has at least one electrical connection (4).

7. The discharge lamp ignition apparatus according to claim 1, wherein the ignition apparatus has a first connector (2), which is fastened to the at least one second electrical connection of the capacitor (C1) and said first connector serves for the electrical and mechanical connection of the capacitor (C1) to a component (TR) of the ignition apparatus.

8. The discharge lamp ignition apparatus according to claim 7, wherein at least one of the connectors (2, 3) is a sheet-metal strip provided with an electrical connection.

9. The discharge lamp ignition apparatus according to claim 7, wherein at least one of the connectors (2, 3) is a power supply wire.

10. The discharge lamp ignition apparatus according to claim 7, wherein at least one of the connectors (2, 3) has at least one U-shaped section.

11. The discharge lamp ignition apparatus according to claim 1, wherein the ignition apparatus has a second connector (3), which is fastened to the at least one second electrical connection of the automatic switch (F1) and serves for the electrical and mechanical connection of the automatic switch (F1) to a component (TR) of the ignition apparatus.

12. The discharge lamp ignition apparatus according to claim 11, wherein at least one of the connectors (2, 3) is a sheet-metal strip provided with an electrical connection.

13. The discharge lamp ignition apparatus according to claim 11, wherein at least one of the connectors (2, 3) is a power supply wire.

14. The discharge lamp ignition apparatus according to claim 11, wherein at least one of the connectors (2, 3) has at least one U-shaped section.

15. A discharge lamp with an ignition apparatus, comprising:

a discharge lamp, a voltage input (J1, J2, J3) for supplying the ignition apparatus with a voltage, an ignition voltage output (J4, J5), a capacitor (C1) having at least one first electrical connection and at least one second electrical connection, an automatic switch (F1) having at least one first electrical connection and at least one second electrical connection, a transformer (TR) having at least one primary winding (N1) and at least one secondary winding (N3), wherein the ignition apparatus has a plate (1), which is composed of an electrically conductive material and on which at least the capacitor (C1) and the automatic switch (F1) are fastened, at least one first electrical connection of the capacitor (C1) and at least one first electrical connection of the automatic switch (F1) being electrically conductively connected to the plate (1).

16. A discharge lamp according to claim 15, wherein the discharge lamp is a high-pressure discharge lamp having a base at one end.

17. A discharge lamp comprising: a discharge vessel (11), a lamp base (10) and electrodes for generating a gas discharge inside the discharge vessel (11), wherein an ignition apparatus having a voltage input (J1, J2, J3) for supplying the ignition apparatus with a voltage, an ignition voltage output (J4, J5), a capacitor (C1) having at least one first electrical connection and at least one second electrical connection, an automatic switch (F1) having at least one first electrical connection and at least one second electrical connection, a transformer (TR) having at least one primary winding (N1) and at least one secondary winding (N3), wherein the ignition apparatus has a plate (1), which is composed of an electrically conductive material and on which at least the capacitor (C1) and the automatic switch (F1) are fastened, at least one first electrical connection of the capacitor (C1) and at least one first electrical connection of the automatic switch (F1) being electrically conductively connected to the plate (1), is arranged in the lamp base (10).

18. A discharge lamp according to claim 17, wherein the discharge lamp is a high-pressure discharge lamp having a base at one end.

* * * * *